US009346056B2

(12) United States Patent
Graef

(10) Patent No.: US 9,346,056 B2
(45) Date of Patent: May 24, 2016

(54) APPARATUS FOR WETTING OF GRAIN WITH A LIQUID, AND METHOD FOR WETTING OF GRAIN WITH A LIQUID

(75) Inventor: Dieter Otto Graef, Lahnau-Dorlar (DE)

(73) Assignee: vibronet Graef GmbH & Co. KG, Lahnau-Dorlar (DE)

( * ) Notice: Subject to any disclaimer, the term of this patent is extended or adjusted under 35 U.S.C. 154(b) by 0 days.

(21) Appl. No.: 13/991,640

(22) PCT Filed: Dec. 6, 2011

(86) PCT No.: PCT/EP2011/071938

§ 371 (c)(1),
(2), (4) Date: Jun. 5, 2013

(87) PCT Pub. No.: WO2012/080041

PCT Pub. Date: Jun. 21, 2012

(65) Prior Publication Data

US 2013/0259996 A1 Oct. 3, 2013

(30) Foreign Application Priority Data

Dec. 17, 2010 (DE) ..... 10 2010 061 318

(51) Int. Cl.
*B02B 1/04* (2006.01)
*B01F 3/12* (2006.01)
*B01F 11/00* (2006.01)

(52) U.S. Cl.
CPC ..... *B02B 1/04* (2013.01); *B01F 3/1228* (2013.01); *B01F 11/0094* (2013.01)

(58) Field of Classification Search
CPC ..... B02B 1/04; B01F 11/0094; B01F 3/1228; B01F 5/0057; B01F 5/0473
USPC ..... 99/516, 518, 534, 536
See application file for complete search history.

(56) References Cited

U.S. PATENT DOCUMENTS

| | | | | |
|---|---|---|---|---|
| 3,741,223 | A * | 6/1973 | Kavera et al. | 134/191 |
| 3,861,294 | A * | 1/1975 | Coldren | 99/516 |
| 4,055,673 | A | 10/1977 | Mueller et al. | |
| 4,829,891 | A * | 5/1989 | Satake | 99/471 |
| 5,002,788 | A * | 3/1991 | Satake | 426/507 |

(Continued)

FOREIGN PATENT DOCUMENTS

| | | | |
|---|---|---|---|
| CH | 463 247 | A | 9/1968 |
| DE | 41 27 290 | A1 | 2/1993 |

(Continued)

OTHER PUBLICATIONS

International Search Report of PCT/EP2011/071938, Mar. 14, 2012.

(Continued)

*Primary Examiner* — David Angwin
*Assistant Examiner* — Lawrence Samuels
(74) *Attorney, Agent, or Firm* — Collard & Roe, P.C.

(57) ABSTRACT

The invention relates to an apparatus for wetting grain with a liquid using a vibrating device for the grain, having a vertically or obliquely or horizontally arranged tube, and to at least one motor, which causes the tube to vibrate and has a motor baseplate for the connection of a vibratory apparatus, in the case of which the tube is connected in a force-fitting manner to the motor baseplate, the tube having a maximum length corresponding to double the length of the motor baseplate. The invention also relates to a method for wetting grain.

20 Claims, 6 Drawing Sheets

(56) References Cited

U.S. PATENT DOCUMENTS

Figure 1:
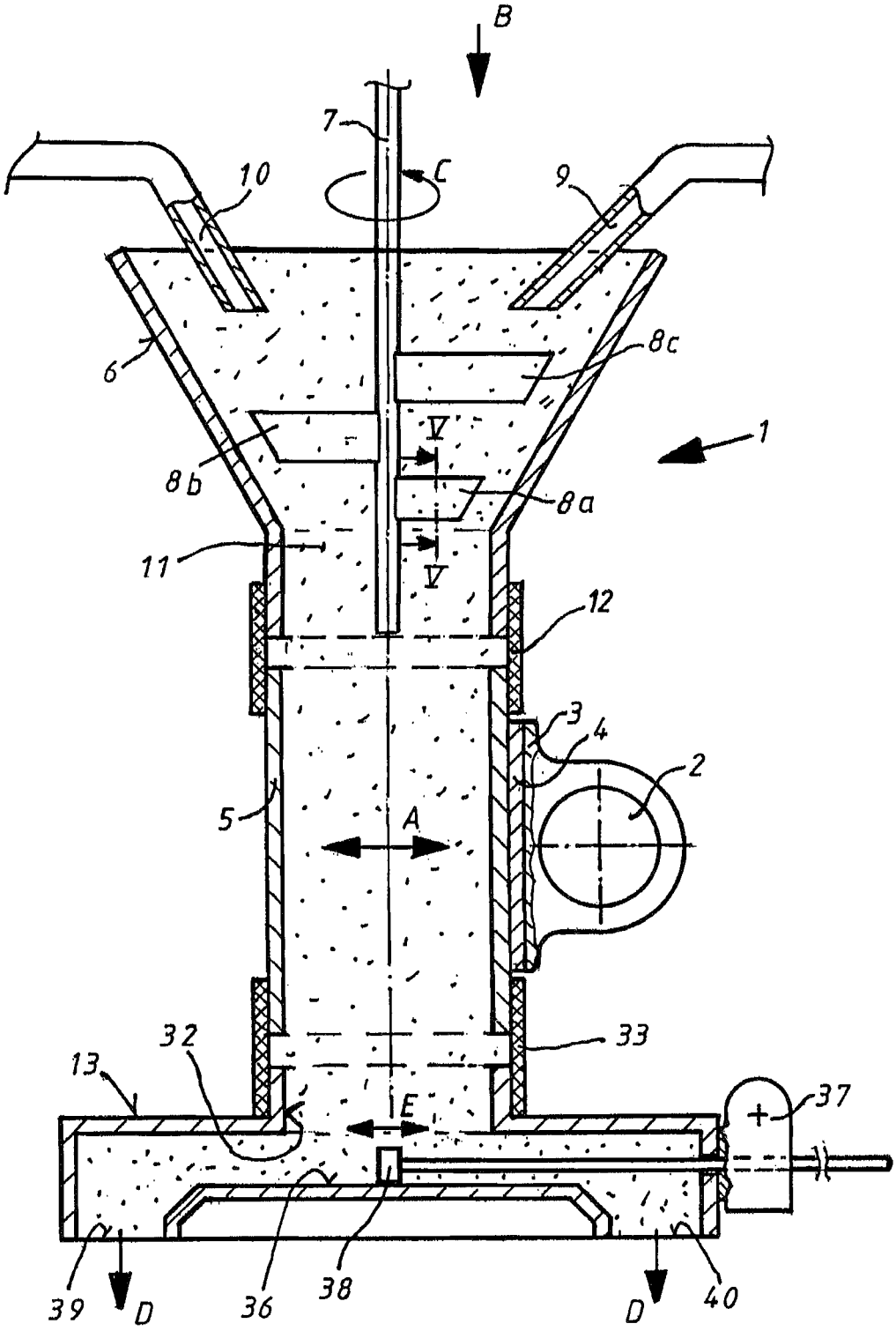

| | | | | | |
|---|---|---|---|---|---|
| 5,512,310 | A | * | 4/1996 | Graef | 426/507 |
| 5,538,747 | A | * | 7/1996 | Mueller | 426/507 |
| 5,586,492 | A | * | 12/1996 | Graef | 99/516 |
| 5,613,428 | A | * | 3/1997 | Kendall et al. | 99/473 |
| 5,886,533 | A | * | 3/1999 | Satake et al. | 324/640 |
| 7,506,829 | B2 | | 3/2009 | Tribuzio et al. | |

FOREIGN PATENT DOCUMENTS

| | | | |
|---|---|---|---|
| DE | 197 33 424 | A1 | 2/1999 |
| FR | 2 540 746 | A1 | 8/1984 |
| JP | 2001-321682 | A | 11/2001 |
| KZ | 20662 | A4 | 1/2009 |
| RU | 2 354 451 | C2 | 5/2009 |
| RU | 2 405 629 | C1 | 12/2010 |

OTHER PUBLICATIONS

German Examination Report dated Oct. 28, 2011 in German Application No. 10 2010 061 318.5 with English translation of relevant parts.

* cited by examiner

APPARATUS FOR WETTING OF GRAIN WITH A LIQUID, AND METHOD FOR WETTING OF GRAIN WITH A LIQUID

CROSS REFERENCE TO RELATED APPLICATIONS

This application is the National Stage of PCT/EP2011/071938 filed on Dec. 6, 2011, which claims priority under 35 U.S.C. §119 of German Application No. 10 2010 061 318.5 filed on Dec. 17, 2010, the disclosures of which are incorporated by reference. The international application under PCT article 21(2) was not published in English.

The invention relates to an apparatus for wetting of grain with a liquid, and to a method for wetting of grain with a liquid.

To obtain flour, the endosperm (endosperm) of a cereal grain must be separated from the bran (husks and germ). For this purpose, the cereal grain is wetted with water, so that the husks soften and can subsequently be peeled off.

The term grain is understood, according to the invention, to mean all crops that have a kernel and a hard or soft husk or skin that surrounds the kernel. The term grain therefore includes all cereal grains as well as legumes, corn, rice, beans, coffee beans, cacao beans, and more of the like.

From practice, it is known to mix grain, in other words cereal grain, for example, with water in a conveying screw (wetting screw). Afterward, the grain is allowed to temper for 12 to 72 hours, depending on the type of grain, so that the water can soften the husks. These long temper times are very disadvantageous, because great space capacity is required for storage during the temper time. Because of this required space capacity, the maximal production capacity of a mill is often restricted.

Furthermore, during longer storage times, increased total germ counts as well as the formation of yeast and mold and the like come about.

The state of the art (DE 41 27 290 C2) includes a method for wetting of grain with a liquid, as well as an apparatus for carrying out the method.

In the case of this apparatus for wetting of grain with a liquid, which belongs to the state of the art, a vibration apparatus is provided, which consists of a tube disposed with an approximately vertical axis, which tube is connected with a motor that puts the tube into a vibration movement.

Proceeding from this state of the art, the present invention is based on the technical problem of indicating an apparatus and a method for wetting of grain with a liquid, with which greater addition of water is possible in a vibration cycle and a temper cycle, in which the temper times are clearly reduced and the yield of light-colored flours is greater. Furthermore, an apparatus is to be indicated that has a clearly reduced construction height and that has clearly better hygiene in the sector of grain.

This technical problem is solved by means of an apparatus and by means of a method having the characteristics according to the invention.

The apparatus according to the invention, for wetting of grain with a liquid, having a vibration device for the grain, which device has a tube and at least one motor that puts the tube into vibration movement, which motor has a motor base plate for connection to an apparatus to be vibrated, is characterized in that the tube is connected, with force fit, with the motor base plate, and that the tube maximally has a length that corresponds to twice the length of the motor base plate.

It is advantageous if the tube is disposed vertically or at a slant or horizontally. Particularly preferred embodiments are a tube disposed vertically or at a slant.

The apparatus according to the invention achieves the following four advantages, among others:

a) Increased addition of liquid is possible.

b) The yield of light-colored flours is clearly higher in the case of grain that was wetted with a liquid by means of the apparatus according to the invention.

c) The temper time of the grain is clearly shortened.

d) A clear energy saving is obtained.

By means of the embodiment of the apparatus according to the invention, the vibration energy of the at least one vibration motor is transferred to the grain directly, and thereby clearly more effectively, so that it is possible, for the first time, to carry out a water addition of 12% in one cycle with this apparatus.

According to the state of the art, only water additions of approximately 8% in one cycle were achieved up to now.

The yield of light-colored flours is clearly higher for grain that was wetted with a liquid, using the apparatus according to the invention. This greater yield of light-colored flours comes about in that the separation between husk and endosperm is clearly improved. The greater yield of light-colored flours amounts to between 0.5% and 1%.

A further advantage of the apparatus according to the invention consists in that a clear reduction in the temper time of the grain is achieved.

According to the state of the art, temper times between 12 and 72 hours are usual, depending on the type of grain.

Grain that was wetted with a liquid, using the apparatus according to the invention, only requires a temper time of two to four hours, for example. In the production of bio-ethanol, temper times of 15 minutes to 60 minutes are actually possible.

In the case of husking methods, peeling methods, or other methods, temper times of 15 to 60 minutes are also possible.

Because the length of the tube maximally corresponds to twice the length of the motor base plate, the ends of the tube itself are not or are hardly put into oscillation. This means that the vibration energy is not converted to oscillation of the tube, but rather is transferred to the grain completely or almost completely.

Because the tube to be vibrated maximally has a length that corresponds to twice the length of the motor base plate, a clear weight reduction in the tube to be vibrated is obtained, as compared with the vibration apparatuses that belong to the state of the art, and thereby an improved, direct transfer of the vibration energy to the grain is achieved.

A further embodiment of the invention provides, when at least two motors are provided, that the tube is connected, with force fit, with each of the motor base plates of the at least two motors, and that the tube maximally has a length that corresponds to twice the sum of the lengths of all the motor base plates. This means that when two motors are provided, for example, the tube is connected, with force fit, with the motor base plate of each motor. The total length of the tube is maximally as great as twice the sum of the lengths of the two motor base plates. In this way, as well, it is guaranteed that the ends of the tube are not put into undesirable oscillation.

According to a preferred embodiment of the invention, the tube has a length that corresponds to the length of the motor base plate. In this embodiment, the ends of the tube are completely prevented from being put into oscillation. This means that the vibration energy is not converted to oscillation energy of the tubes, but rather can be transferred completely to the grain. In this way, it is guaranteed that the grain, which was mixed with the liquid before passing through the tube, is completely exposed to the vibration energy, and that the liquid clearly penetrates into the grain better, and thereby the temper time is reduced once again.

According to a further embodiment of the invention, the tube minimally has a length that corresponds to the length of the motor base plate. However, the possibility also exists of configuring the tube to be shorter. In this case, an adapter plate, for example, is required between the motor base plate and the tube.

A particularly preferred embodiment of the invention provides that the force-fit connection with the vibration motor is disposed approximately in the center of the tube. In this way, the vibration energy of the motor is optimally transferred to the tube, once again without undesirable oscillations of the tube occurring.

A force-fit connection is understood to be the connection between the motor base plate of the vibration motor and the tube or between the motor base plate of the vibration motor and at least one further plate, between which the tube is disposed or on which the tube is disposed, in order to transfer the vibrations from the motor to the tube or to the at least one plate, and thereby to the tube.

The motor base plate is an integral part of the motor. The motor base plate is the plate that transfers the vibration movements from the motor to the apparatus to be vibrated, which is connected with the motor base plate for this purpose.

The tube can advantageously have a round, elliptical, or angular cross-section. It is possible, for example, to use a square tube. Other cross-sections are also possible.

A further advantageous embodiment of the invention provides for configuring the tube from at least two individual tubes that are put together. It is particularly advantageous to use square tubes that stand in connection with one another with their outer surfaces, over the full area, and are firmly connected with one another in this structure. This embodiment of the tube demonstrates the advantage that the structure is very simple, and that the tube has greater rigidity than a simple square tube.

According to a further embodiment of the invention, the tube consists of solid material and has a plurality of bores that are continuous in the longitudinal direction, through which the grain/liquid mixture is conveyed.

According to another advantageous embodiment of the invention, the tube has partition walls that can be variably inserted into the tube (round tube/square tube). The possibility also exists that the tube has firmly inserted partition walls, and that depending on the use, the matching tube is disposed in the apparatus, in each instance.

In this way, it is possible to structure the dimension of the cross-sections in the tube in variable manner, in order to achieve maximal acceleration for different kinds of grain. The larger the cross-sectional surface area of the tube, the longer the dwell time of the grain/liquid mixture in the tube at the same throughput amount. Because of the longer dwell time, the vibration energy can be introduced into the grain/liquid mixture with greater effect.

According to a further advantageous embodiment of the invention, the tube and/or the partition walls are provided with a coating, at least in part. It is advantageous if an anti-adhesion coating and/or a friction-wear-resistant coating and/or an electrostatically dissipative coating and/or a chemically resistant coating, which guarantees corrosion protection, for example, is/are provided. It is particularly advantageous if the tube and/or the partition walls is/are coated, at least in part, with Teflon (registered trademark of E.I. du Pont de Nemours and Co., Wilmington, Del., USA). By means of the coating with Teflon or the other materials, which coating reduces the adhesion effect of the grain/liquid mixture on the tube or the partition walls, the result is achieved that the grain/liquid mixture does not adhere so easily to the tube and the partition walls. Ideally, adhesion should be avoided completely. In this way, the pass-through behavior of the grain/liquid mixture through the tube is optimized. This is necessary so that the tube does not become clogged by the grain/liquid mixture and so that no mold or yeast formation occurs as the result of small adhesions of the grain/liquid mixture, and that the total germ count is kept low.

According to a further preferred embodiment of the invention, the apparatus has a pre-mixer, in which the liquid is added to the grain, and the grain is gently mixed with the liquid, without breakage or friction wear, in other words without damage to the outer husk layers. For this purpose, the pre-mixer has at least one mixer paddle that is configured to be rounded off on a back side. The grain and the liquid are mixed with one another using the at least one mixer paddle. Adhesions of the grain/liquid mixture to the mixer paddle are prevented by the rounding of the at least one mixer paddle on the back side, and thereby the hygiene in the apparatus is improved once again. By means of the pre-mixer, the result is achieved that the grain is uniformly mixed with the liquid, so that the vibration energy in the subsequent tube is transferred to the uniformly mixed grain/liquid mixture, and in this way, optimal penetration of the liquid into the grain is guaranteed.

The mixer paddles are advantageously disposed at a distance from the water feed, so that the supplied water first trickles away between the grain. Because the at least one mixer paddle is disposed at a distance, the water is not carried toward the outside in the pre-mixer by the mixer paddle, and as a result, according to the state of the art, deposits of dust, wear particles, and water are formed. These deposits increase the total germ count, as well as the formation of mold and yeast. Because the mixer paddles are disposed at a distance from the water feed, the grain is also put into a slight rotational movement above the mixer paddles, thereby causing a first distribution of the supplied water to take place. Only in the region of the mixer paddles does complete mixing of the grain with the water then take place.

According to a further advantageous embodiment of the invention, the back side of the at least one mixer paddle is configured to be semi-circular in cross-section. In this way, adhesions of the grain/liquid mixture are prevented, to a great extent.

It is advantageous if the pre-mixer is made from stainless steel and/or from steel. This embodiment demonstrates the advantage that greater hygiene is achieved in the pre-mixer. It is also possible to make the pre-mixer from carbon fibers, ceramic, aluminum and/or plastic, or from other materials.

In order to increase the pre-mixing effect in the mixer, in other words to achieve better pre-mixing of the grain with the liquid, at least one water feed element is disposed in the pre-mixer. Depending on the diameter of the pre-mixer, it is advantageous if multiple water feed elements are provided, as a function of the diameter of the pre-mixer.

It is advantageous if the drive of the pre-mixer is configured to be frequency-controlled, for variable speed regulation, in order to achieve optimal pre-mixing, depending on the type of grain.

According to a further preferred embodiment of the invention, the motor drives the tube at a frequency of at least 65 Hz, preferably at least 70 Hz.

Starting from this frequency, optimal penetration of the liquid into the grain is achieved, so that the goal aimed at, of at least 12% water addition in one cycle, is achieved in this way.

It is advantageous if the grain/liquid mixture is exposed to great acceleration during the vibration process, namely on the order of 5 g to 15 g (g=gravity), preferably 13 g to 15 g. Despite this great acceleration, the grain/liquid mixture does not have a hard impact on the walls, because the grain mixed with the liquid is disposed in the tube or in the tube chambers in relatively compact manner, in other words the energy transfer to the grain/liquid mixture does not take place as the result of hard impacts on this mixture, but rather by the grain and, if applicable, the liquid droplets lying against the tube wall or a partition wall. The surface tension of the liquid is canceled out by the great acceleration. As a result, the liquid film lies against the entire grain surface.

The vibration time of the grain mixed with the liquid advantageously amounts to approximately 2 to 20 seconds in the tube.

The grain mixed with the liquid can pass through the vibration device continuously or discontinuously (in batches).

It is advantageous if the grain is disposed in the at least one tube in compact manner, and passes through it in compact manner.

It is advantageous if the pre-mixer is configured to be conical in cross-section, with a narrowing toward the bottom, or cylindrical, or conical with a narrowing toward the top. In these pre-mixers, improved and optimal mixing of the grain with the liquid is guaranteed.

By means of the improved mixing in the pre-mixer, and by means of the vibration according to the invention, the added water also penetrates into the grain crease, for the first time, which crease makes up one-sixth of the total grain surface.

In this way, the total flour yield is increased. Furthermore, a higher percentage of semolina and middlings occurs.

Fundamentally, the possibility exists of also adding a food-compatible disinfectant. Because this can also penetrate all the way into the grain crease for the first time, the total germ count, as well as mold and yeast, is reduced in this way.

In order to additionally reduce the temper time, in the method according to the invention, for wetting of grain with a liquid, in an apparatus according to the invention, the grain can be mixed with softened water and subsequently vibrated. Calcium and magnesium have been removed from the softened water. In this way, the method according to the invention makes use of the effect of osmosis. Calcium and magnesium, among other things, are usually contained in the husks of the grain. If the grain is mixed with water from which calcium and magnesium were removed, the water penetrates into the husk of the grain more rapidly, due to the increased osmosis effect, so that here, even more rapid water absorption can be achieved.

Because of the increased osmosis effect in mixing and/or vibration with the softened water, the liquid penetrates into the outer layers of the grain clearly more rapidly at the beginning of the temper time. This process can be observed over a time period of 15 minutes to three hours. This effect is advantageous, for example, in durum wheat milling, in bio-ethanol production, or in methods for the production of flour in which the outer husk layers are to be removed using peelers. In these applications, it is important that the water penetrates quickly from the surface into the husk, and not into the kernel.

Using the apparatus according to the invention, it is possible to warm the grain before the temper process. In some regions, grain is stored at very low temperatures, for example minus 15° Celsius, before being processed further. As a result of the vibration using the apparatus according to the invention, the grain then warms up, due to the friction of the individual grains against one another, to 0° Celsius, for example, so that the grain has a clearly higher temperature at the beginning of the temper process than according to the state of the art. Because of the higher temperature of the grain, it absorbs a higher content of water during the temper time. If the grain is passed to the grinding process at a correspondingly higher temperature after the temper time, a clearly higher flour yield and lighter-colored flours are additionally obtained than if the grain is ground in the cold or actually the frozen state. Furthermore, the formation of condensed water is clearly reduced or actually prevented.

Primarily, water is the liquid used for preparation. Additives soluble in liquid or miscible with liquid can be added to the liquid. Liquid-soluble or liquid-miscible additives can be, for example, enzymes, emulsifiers and/or pigments, disinfectants, seed treatments, insecticides, pesticides and/or pigments. Also, sugar water, molasses, or liquids for the reduction of the total germ count, for example, can be added to the grain. The additives are at least partly dissolved in the liquid. It is not necessary for them to be completely dissolved.

According to an advantageous embodiment of the invention, it is possible to mix the liquid that is added to the grain in the pre-mixer with at least one of the aforementioned liquid-soluble additives. The grain is mixed with the liquid and with the liquid-soluble additives, and subsequently vibrated. The flour yield of the grain that is mixed with a liquid and vibrated is clearly increased. The grain furthermore has a greater ability to germinate, and the grain crop grows more quickly.

This effect is due to the fact that the liquid is better introduced into the germinating seed.

With the apparatus, it is possible, for the first time, to introduce liquid into the grain crease. If liquid is introduced into the grain crease, which consists of bran and endosperm, a greater total flour yield is obtained, with lighter-colored ashes. This effect is due to the fact that the grain crease amounts to approximately ⅙ of the total individual grain surface, and that therefore the entire individual grain is wetted with the liquid for the first time as the result of penetration of the liquid into the grain crease.

The addition of insecticides by means of the apparatus according to the invention is also advantageous, because the insecticides can also penetrate into the grain crease in clearly improved manner, and therefore better protect the individual grain against insect infestation.

Figure 2:
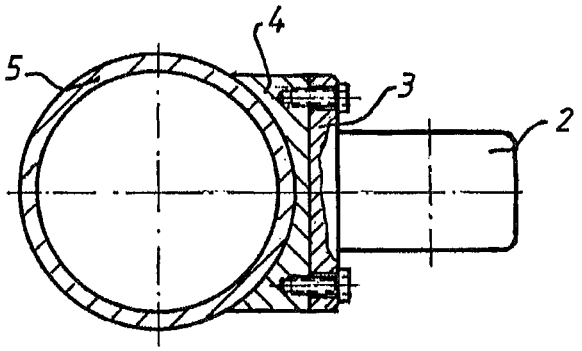
Figure 3:
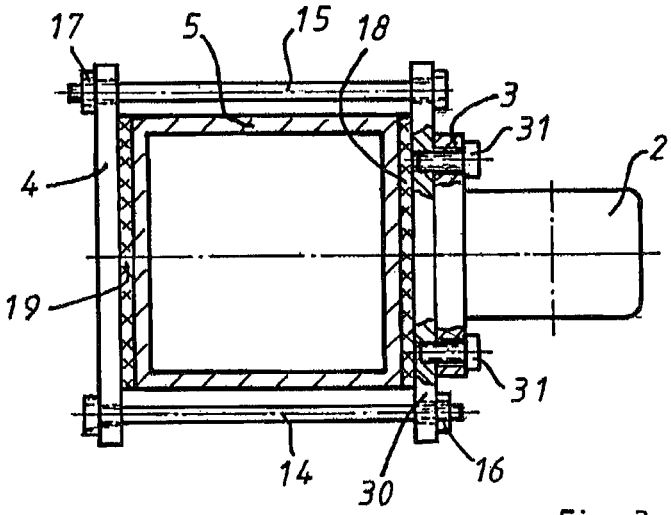
Figure 4:
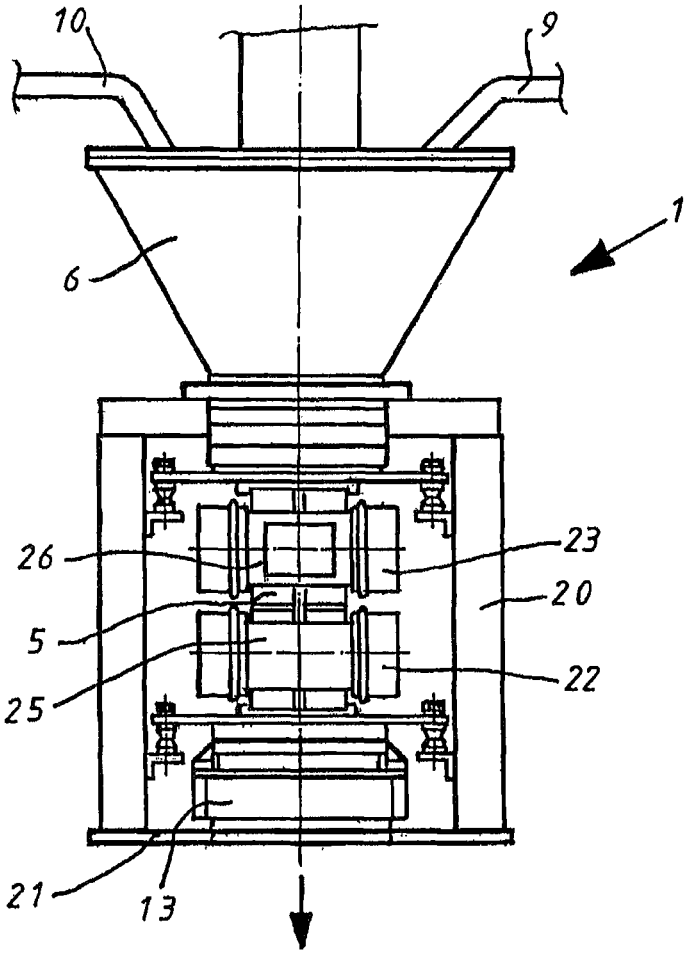
Figure 5:
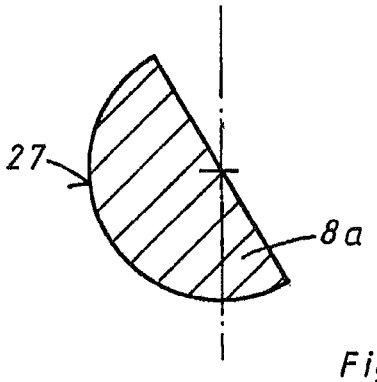
Figure 6:
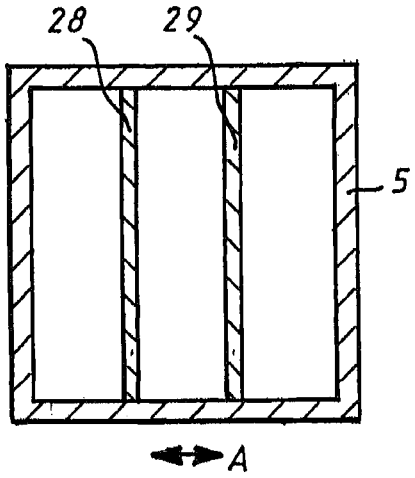
Figure 7:
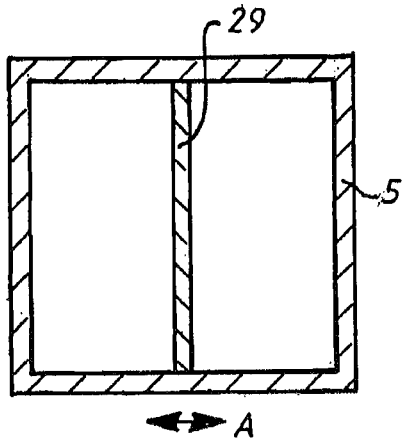
Figure 8:
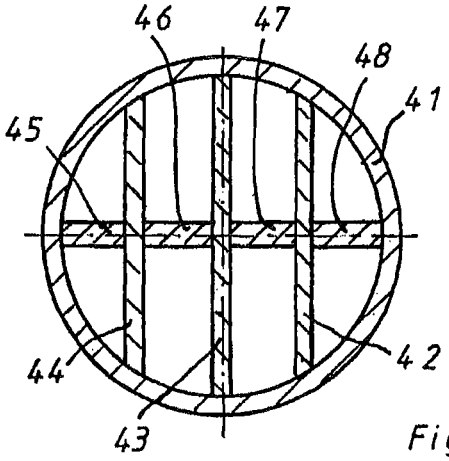
Figure 9:
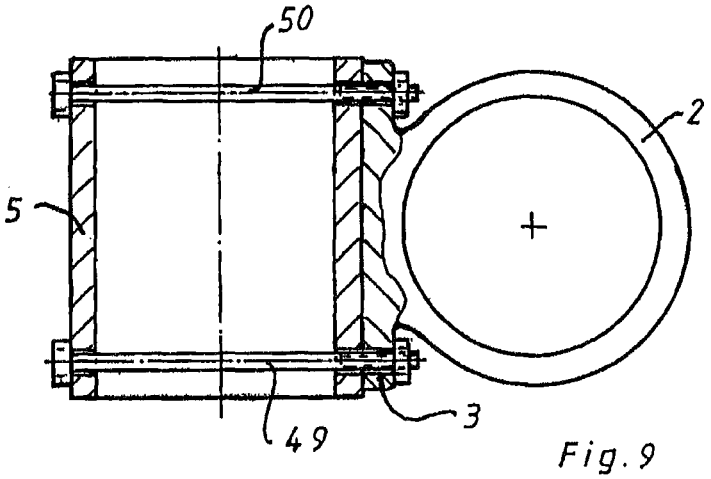
Figure 10:
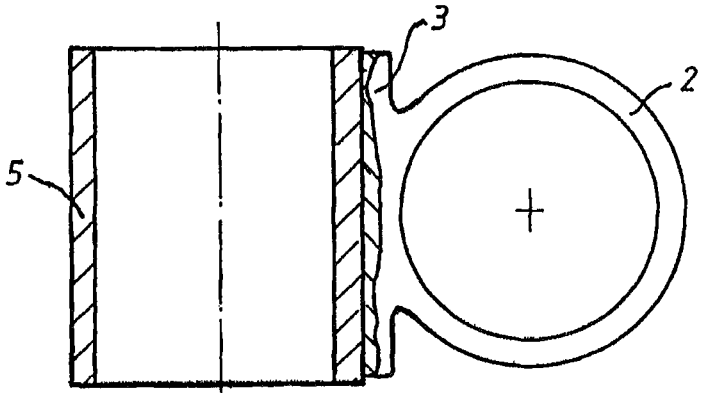
Figure 11:
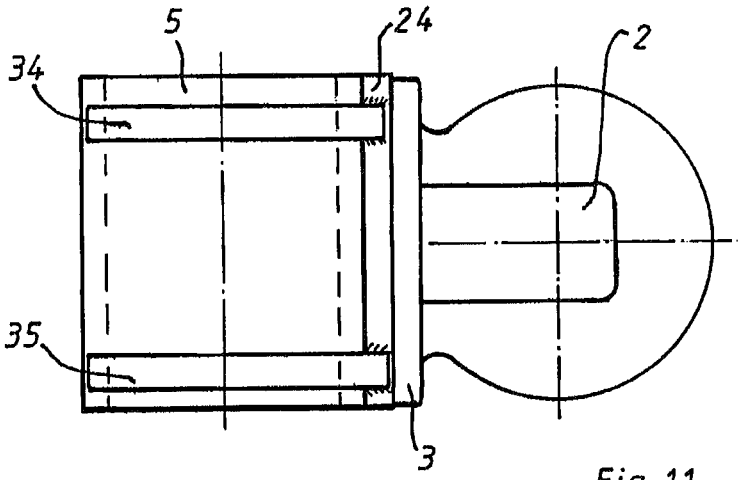
Figure 12:
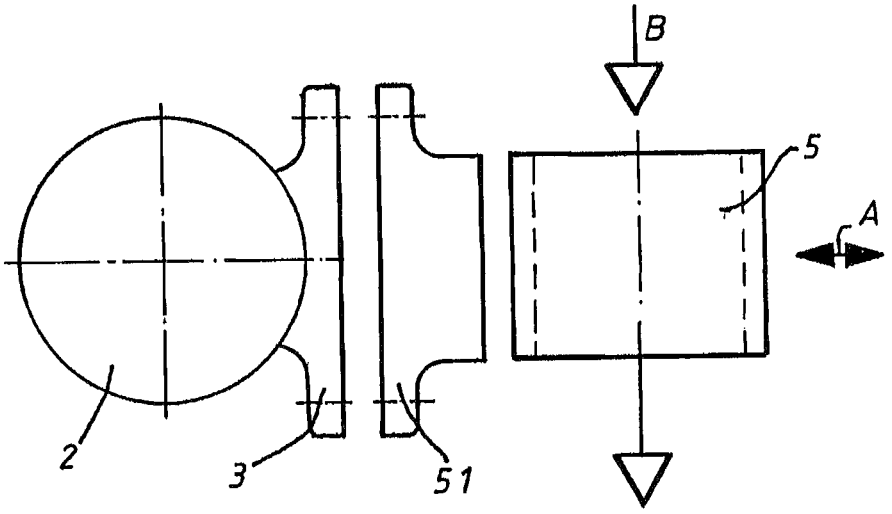

Further characteristics and advantages of the invention are evident from the attached drawing, in which an exemplary embodiment of a vibration apparatus according to the invention is shown as an example. The drawing shows:

FIG. 1 a cross-section through a vibration apparatus according to the invention;

FIG. 2 the tube according to FIG. 1 in cross-section;

FIG. 3 a cross-section through a square tube having two plates;

FIG. 4. a modified exemplary embodiment in a side view, with two motors;

FIG. 5 a cross-section through a mixer paddle along the line V-V of FIG. 1;

FIG. 6 a tube with partition walls, in cross-section;

FIG. 7 a tube with a partition wall, in cross-section;

FIG. 8 a modified exemplary embodiment of a tube with partition walls;

FIG. 9 a tube screwed onto a motor base plate;

FIG. 10 a tube welded onto a motor base plate;

FIG. 11 a modified exemplary embodiment of a tube, in a side view;

FIG. 12 an exemplary embodiment in a side view.

FIG. 1 shows an apparatus 1 for wetting of grain. The apparatus 1 has a motor 2 that in turn has a motor base plate 3, on which the tube 5 with a plate 4, as shown in FIG. 2, is disposed, with force fit.

According to FIG. 1, the motor 2 is configured as a vibration motor, and puts the tube 5, which is disposed on the motor base plate 3 and the plate 4, into vibration movement in the direction of the double arrow A.

Grain 11 is filled into the apparatus 1 in the direction of the arrow B, specifically into a pre-mixer 6. In the pre-mixer 6, mixer paddles 8*a*, 8*b*, 8*c* are mounted by means of a motor-driven shaft 7, so as to rotate in the direction of the arrow C. The liquid, for example water, is added to the grain 11 in the pre-mixer 6, by way of feed pipes 9, 10.

The uppermost mixer paddle 8*c* is disposed at a distance from the water feed pipes 9, 10. In this way, it is guaranteed that the water is distributed in the pre-mixer by means of a rotational movement that the grain 11 performs in the region of the feed pipes 9, 10. If the uppermost mixer paddle is disposed too close to the feed pipes 9, 10, only the supplied water is pressed to the outside, thereby bringing about a mixture of dust, friction-wear particles, and water, which is pressed toward the outside in the pre-mixer 6.

After the pre-mixer, the grain 11 is passed to the tube 5. In order for all the grain to get into the tube 5, a flexible sealing and connecting element 12 is provided, which can be configured as a rubber collar, which is disposed on the pre-mixer 6 as well as on the tube 5.

The grain/liquid mixture is exposed to the vibration of the motor 2 in the tube 5. Subsequently, the vibrated grain/liquid mixture gets into a discharge apparatus 13, from which the grain/liquid mixture leaves the apparatus 1 in the direction of the arrows D.

The discharge apparatus 13 is characterized by a particularly low construction height.

The discharge apparatus 13 has an inlet 32, through which the grain gets out of the pipe 5 into the discharge apparatus 13. The transition between the tube 5 and the discharge apparatus 13 is once again structured by means of a flexible sealing and connecting element 33. The flexible sealing and connecting element 33, which is configured as a rubber collar, for example, is disposed on the tube 5 as well as on the discharge apparatus 13.

The grain 11 gets onto a bottom plate 36 in the discharge element. A pusher 38 driven by a motor 37, in the direction of the double arrow E, moves the grain toward outlet openings 39, 40.

The tube 5 and the motor plate 3 have almost the same length. In this way, it is guaranteed that the vibration energy of the motor 2 is transferred completely or almost completely onto the grain/liquid mixture, thereby bringing about optimal wetting of the grain with the liquid. In this way, it is guaranteed that ends of the tube 5 are not put into oscillation, thereby converting the vibration energy of the motor 2 into undesirable oscillation energy. Furthermore, the apparatus has a relatively low construction height, as a whole, because of this configuration.

Because the pre-mixer 6 is kept very low in terms of its construction height, due to the fact that the tube 5 has a maximal length that corresponds to twice the length of the motor plate 3, and because the discharge apparatus 13 has a very low construction height, the total construction height of the apparatus 1 is very low, so that it can be installed and used even in the case of very tight spatial conditions.

For optimal mixing of the grain with the liquid, it is advantageous to dispose multiple feed pipes with the liquid in the pre-mixer 6. In FIG. 1, only the two feed pipes 9, 10 are shown. At least four to six feed pipes (depending on the capacity size) are optimal.

According to FIG. 2, only the motor 2 with the motor base plate 3 and a further plate 4 is shown. The tube 5 is configured to be round in cross-section.

FIG. 3 shows a tube 5 that is square in cross-section and is disposed between plates 4, 30. The plates 4, 30 are moved toward one another by means of screws 14, 15 and screw nuts 16, 17, and thereby clamp the tube 5. In order to prevent slipping of the tube 5 between the plates 3, 4, rubber plates 18, 19 are additionally provided between the tube 5 and the plates 4, 30. The rubber plates 18, 19 are configured in such a manner that they prevent slipping of the tube 5 between the plates 3, 4, but do not absorb any vibration energy, if possible. The plate 30 is fastened onto the motor base plate 3 of the motor 2 by means of screws 31.

FIG. 4 shows the apparatus 1 disposed in a frame 20. The frame 20 is fixed in place on a floor plate 21. The tube 5 is put into vibration by two motors 22, 23. The motors 22, 23 are synchronized for this purpose. The discharge apparatus 13 is structured as described in FIG. 1. The motors 22, 23 transfer the vibration energy to the tube 5 by way of plates 25, 26.

FIG. 5 shows the mixer paddle 8*a* of FIG. 1 in cross-section. The mixer paddle 8*a* is configured in the shape of a semi-circle in cross-section on a back side 27. By means of the semi-circular configuration of the back side 27 of the mixer paddle 8*a*, it is guaranteed that the grain/liquid mixture does not adhere to the mixer paddle 8*a*. By means of this configuration, optimal mixing is achieved, and also, the required hygiene is maintained.

FIG. 6 shows the tube 5, in which partition walls 28, 29 are disposed. By means of the placement of the partition walls 28, 29 in the tube 5, the vibration energy is optimally transferred to the grain, depending on the type of grain. The movement direction of the tube 5 is shown with the double arrow A. The division in the tube 5 can vary.

As shown in FIG. 7, only one partition wall 29 is not disposed in the tube 5. Placement of a partition wall is advantageous in the case of larger grain, such as cacao beans or the like, while placement of two or more partition walls is advantageous in the case of smaller grain, such as cereal grains.

The tube 5 and the partition walls 28, 29 are advantageously coated with Teflon (not shown (registered trademark of E.I. du Pont de Nemours and Co., Wilmington, Del., USA)).

In FIG. 8, a tube 41 that is round in cross-section is shown, which has partition walls 42, 43, 44 as well as 45, 46, 47, 48.

FIG. 9 shows the tube 5, which is disposed on the motor base plate 3 of the motor 2 by means of screws 49, 50.

According to FIG. 10, the tube 5 is firmly welded onto the motor base plate 3 of the motor 2.

FIG. 11 shows the tube 5, which is fastened onto the motor base plate 3 of the motor 2 by way of an intermediate plate 24. Because no further plate is disposed on the side of the tube 5 that faces away from the motor 2, in other words lying opposite the plate 24, flat bars 34, 35 are fastened onto the tube 5 on the outside, which bars support and promote a transfer of the vibrations to the side of the tube 5 facing away from the motor 2. The plates 34, 35 are firmly welded onto the tube 5, for example.

FIG. 12 shows the motor 2 with the motor base plate 3, on which an adapter plate 51 can be disposed. The tube 5 is fastened onto the adapter plate 51. The grain gets into the tube in the direction of the arrow B, and is vibrated in the direction of the double arrow A there.

REFERENCE NUMBERS

1 apparatus
2 motor
3 motor base plate
4 plate
5 tube
6 pre-mixer
7 shaft
8*a* mixer paddle
8*b* mixer paddle
8*c* mixer paddle
9 feed pipe
10 feed pipe
11 grain
12 flexible sealing and connecting element
13 discharge apparatus
14 screws
15 screws
16 screw nut
17 screw nut
18 rubber plate
19 rubber plate
20 frame
21 floor plate
22 motor
23 motor
24 plate
25 plate
26 plate
27 back side of the mixer paddle 8
28 partition wall
29 partition wall
30 plate
31 screws
32 inlet opening of the discharge apparatus 13
33 flexible sealing and connecting element
34 flat bar
35 flat bar
36 bottom of the discharge apparatus 13
37 motor
38 pusher
39 outlet opening
40 outlet opening
41 tube
42 partition walls
43 partition walls
44 partition walls
45 partition walls
46 partition walls
47 partition walls
48 partition walls
49 screw
50 screw
51 adapter plate
A double arrow
B arrow
C arrow
D arrow
E double arrow

The invention claimed is:

1. An apparatus for wetting of grain with water comprising:
a pre-mixer having at least one water feed element, wherein the pre-mixer is configured to mix a liquid and the grain;
a vibration device configured to receive the mixed liquid and grain and further configured to vibrate the grain, the vibration device having a tube and at least one motor, the motor configured to vibrate the tube;
the motor having a motor base plate connected to the tube;
wherein the tube is configured to receive the motor base plate by force fit and the tube is connected to the motor base plate along the entire length of the motor base plate;
wherein the tube maximally has a length that corresponds to twice the length of the motor base plate;
wherein the tube length and base plate length are configured to substantially prevent the tube's ends from oscillation; and
wherein the tube length and the motor base plate length are measured along the same axis.

2. Apparatus according to claim 1, wherein the tube (5) is disposed vertically or at a slant or horizontally.

3. Apparatus according to claim 1, wherein the tube (5) is configured to be shorter than the length of the motor base plate (3) and wherein an adapter plate is provided between the motor base plate (3) and the tube (5).

4. Apparatus according to claim 1, wherein the tube (5) is connected, with force fit, with each of the motor base plates (25, 26) of at least two motors (22, 23), and wherein the tube (5) maximally has a length that corresponds to twice the sum of the lengths of all the motor base plates (25, 26).

5. Apparatus according to claim 1, wherein an intermediate plate (4, 30, 51) is fastened onto the motor base plate (3), and wherein the tube (5) is fastened onto the intermediate plate (4, 30, 51).

6. Apparatus according to claim 1, wherein the tube (5) is fastened between two plates (4, 30), wherein the plate (30) is connected, with force fit, with the at least one motor base plate (3).

7. Apparatus according to claim 1, wherein the tube (5, 41) has partition walls (28, 29, 42 to 48).

8. Apparatus according to claim 1, wherein the apparatus (1) has a pre-mixer (6) in which the liquid is added to the grain (11), and wherein the pre-mixer (6) has at least one mixer paddle (8*a*, 8*b*, 8*c*) that is configured to be rounded off on a back side (27).

9. Apparatus according to claim 8, wherein the mixer paddles (8*a*, 8*b*, 8*c*) are disposed at a distance from a water feed, in such a manner that the supplied water first trickles away between the grain.

10. Apparatus according to claim 8, wherein the back side (27) of the at least one mixer paddle (8*a*, 8*b*, 8*c*) is configured to be rounded off.

11. Apparatus according to claim 8, wherein at least one water feed element (9, 10) is disposed in the pre-mixer (6).

12. Apparatus according to claim 8, wherein the drive of the pre-mixer (6) is configured to be frequency-controlled, for variable speed regulation.

13. Apparatus according to claim 1, wherein the at least one motor (2; 22, 23) puts the tube (5) into vibration at a frequency of at least 65 Hz.

14. Apparatus according to claim 1, wherein vibration of the grain/liquid mixture is provided at 5 g to 15 g (g=gravity).

15. Apparatus according to claim 1, wherein vibration of the grain/liquid mixture is provided at 13 g to 15 g (g=gravity).

16. Method for wetting of grain with a liquid, using an apparatus according to claim 1, wherein the grain (11) is mixed with softened water and subsequently vibrated.

17. Method for wetting of grain with a liquid, according to claim 16, wherein at least one liquid-soluble and/or at least one liquid-micible additive is mixed into the liquid, and wherein the grain (11) is subsequently mixed with the liquid and the at least one liquid-soluble or liquid-miscible additive, and subsequently vibrated.

18. Method according to claim 16, wherein the grain/liquid mixture is vibrated at a frequency greater than 65 Hz.

19. Method according to claim 16, wherein the grain/liquid mixture is vibrated at about 5 g to 15 g (g=gravity).

20. Method for vibration of grain, according to claim 16, wherein the grain is heated by the vibration process.

* * * * *